US009388954B2

(12) United States Patent
Lai

(10) Patent No.: US 9,388,954 B2
(45) Date of Patent: Jul. 12, 2016

(54) DYNAMIC FLAME SIMULATING DEVICE

(71) Applicant: Wen-Cheng Lai, Taoyuan County (TW)

(72) Inventor: Wen-Cheng Lai, Taoyuan County (TW)

( * ) Notice: Subject to any disclaimer, the term of this patent is extended or adjusted under 35 U.S.C. 154(b) by 0 days.

(21) Appl. No.: 14/464,710

(22) Filed: Aug. 21, 2014

(65) Prior Publication Data

US 2016/0053954 A1 Feb. 25, 2016

(51) Int. Cl.
*F21S 10/04* (2006.01)
*F21S 6/00* (2006.01)
*F21V 23/00* (2015.01)

(52) U.S. Cl.
CPC ..... *F21S 10/046* (2013.01); *F21S 6/001* (2013.01); *F21V 23/00* (2013.01)

(58) Field of Classification Search
CPC ..... F21S 10/046
See application file for complete search history.

(56) References Cited

U.S. PATENT DOCUMENTS 7,850,346 B1 * 12/2010 Lauer ..... F21S 10/04 362/272
2006/0146544 A1 * 7/2006 Leung ..... F21S 6/001 362/392
2008/0112154 A1 * 5/2008 Reichow ..... F21S 10/04 362/96
2009/0135586 A1 * 5/2009 Yang ..... F21S 10/002 362/101
2011/0043309 A1 * 2/2011 Wamala ..... H01F 7/066 335/260
2011/0110073 A1 * 5/2011 Schnuckle ..... F21S 10/04 362/96
2012/0134157 A1 * 5/2012 Li ..... F21S 6/001 362/277
2013/0223043 A1 * 8/2013 Ray ..... F21V 33/00 362/96
2014/0104869 A1 * 4/2014 Spangler ..... G09F 13/18 362/560
2014/0211499 A1 * 7/2014 Fong ..... F21S 6/001 362/558
2014/0218903 A1 * 8/2014 Sheng ..... F21S 10/04 362/190
2014/0313694 A1 * 10/2014 Patton ..... F21S 10/046 362/96
2015/0036348 A1 * 2/2015 Dong ..... F21S 10/046 362/293

* cited by examiner

*Primary Examiner* — Charlie Y Peng
(74) *Attorney, Agent, or Firm* — C. G. Mersereau; Nikolai & Mersereau, P.A.

(57) ABSTRACT

A dynamic flame simulating device mainly comprises an upper base, a flame element suspended from the upper base, a light source providing light rays, and a driving assembly below the flame element. The driving assembly further comprises an electromagnetic coil and a second magnetic element, wherein the electromagnetic coil is powered on to drive the second magnetic element to bounce toward a first magnetic element on the bottom end of the flame element to generate repellent magnetic acting forces to make the flame element swing naturally and achieve the dynamic visual effect of the natural beating of the burning flame.

10 Claims, 5 Drawing Sheets

DYNAMIC FLAME SIMULATING DEVICE

BACKGROUND OF THE INVENTION (1) Field of the Invention

The invention relates to electronic lighting for simulating a candle frame, and more particularly to a dynamic flame simulating device capable of simulating a dynamic effect of a burning candle frame.

(2) Description of the Prior Art

In today's society, although conventional illumination tools, such as candles, oil lamps or the like, have been replaced by various electric lamps, the candles or the oil lamps still have conventional meanings and distinctive visual effects in some special occasions or special situations, and thus cannot be replaced by the illumination lamps used in the today's daily life. For example, upon worshiping deities or ancestors, incense and candles are often used, and the beating fire on the candle is used to anchor the reminiscence on the ancestor and the endless longing to the posterity. Alternatively, in some occasions where specific atmospheres need to be created, the fire beating effect of the burning candle is also advantageous to the generation of different visual enjoyments. However, the conventional lamps, such as candles, oil lamps or the like, are used for illumination by way of flame combustion, and have the predetermined security risks. When the candles or oil lamps are upset due to the wind blowing or the artificial inadvertent touch, the ambient flammable objects tend to be ignited to cause the fire accident. Thus, simulated lamps for simulating candle illumination effects have been developed.

Therefore, many lamps capable of simulating frames have been available in the market. The earlier flame lamp has a lamp holder configured to have an external shape similar to that of a candlestick, a translucent lamp shade with a flame shape is disposed on a top of the lamp holder, and an electronic light source is disposed in the lamp shade. The electrical energy drives the electronic light source to emit light rays through the flame shaped lamp shade to achieve the effect of simulating the candle frame. However, the lamp shade of such the flame lamp has the fixed shape, and the stable light source is formed after the flame lamp is turned on, and this effect is significantly different from the dynamic visual effect of the beating flame upon burning of the candle frame.

In addition, improvements have been continuously made so that a flame lamp has been available in the market. In the frame lamp, a sheet-like body with a flame model is mounted on a lamp head using an iron wire penetrating through the lamp head so that the sheet-like body is suspended from the lamp head, and a light source is provided to illuminate the sheet-like body to simulate the outlook of the flame. Also, a driving mechanism is provided to drive the sheet-like body to swing by way of actuating or beating, thereby forming the dynamic visual effect. However, although the mounting of the iron wire through the hole can implement the swinging of the sheet-like body to a predetermined extent, the iron wire is fixed, and the swinging direction and amplitude of the sheet-like body are extremely restricted in order to prevent the sheet-like body and the driving mechanism from offsetting. Thus, the flame lamp cannot simulate the perception of the dynamic flame, and is still significantly different from the naturally beating flame.

In view of the associated problems induced by the design defects of the conventional simulated flame lamp, the present inventor has paid attention to the research and development of the simulation of the beating flame, and thus developed this invention after many tries.

SUMMARY OF THE INVENTION

An object of the invention is to provide a dynamic flame simulating device having a suspending mode, which does not restrict the flame element, and an operation mode of driving a magnet to bounce repeatedly to make the swinging of the flame element more realistic and natural, thereby significantly improving the problem of the lighting product of the conventional simulated flame.

Another object of the invention is to provide a simple structure suitable for the mass production, thereby significantly decreasing the production cost.

To achieve the above-identified objects, the invention provides a dynamic flame simulating device comprising an upper base, a flame element, a light source and a driving assembly. The upper base has a hooking portion. The flame element has an upper section having a flame model outlook, and a lower section having a bottom portion on which a first magnetic element is disposed. The flame element is formed with a blind hole in a direction of a center of gravity, wherein the blind hole is hung from the hooking portion so that the flame element may swing on the hooking portion. The light source is disposed on the upper base and provides light rays on the upper section of the flame element. The driving assembly is disposed below the upper base and the flame element, and comprises an electromagnetic coil and a second magnetic element. An axis of the electromagnetic coil is directed toward the first magnetic element on a bottom end of the flame element, and the second magnetic element is disposed on an inner side opposite to the electromagnetic coil. After the electromagnetic coil is powered on, an electromagnetic acting force is applied to the second magnetic element so that the second magnetic element reciprocates in a predetermined path toward the first magnetic element. Opposite facing surfaces of the second magnetic element and the first magnetic element are magnetic poles with the same magnetic property to generate repellent magnetic acting forces to drive the flame element to swing.

Compared with the conventional product with the linear contact suspending mode, the invention uses the single-point contact suspending mode to effectively overcome the limitation of the swinging angle of the flame element, and decrease the contact friction generated so that the flame element swings more naturally, and the optimum dynamic beating effect of simulating the flame can be obtained. Furthermore, compared with the conventional product using the electric motor and having the cost that cannot be decreased, the invention utilizes the electromagnetic coil as the driving source, thereby effectively decreasing the material cost, and decreasing the electric energy consumption of the product in use so that the product can be used for a longer period of time. In addition, the periodic swinging problem of the flame element caused by the driving of the electric motor can be solved.

Preferably, the driving assembly further comprises a limit tube body having the predetermined path, wherein the second magnetic element is disposed in the limit tube body to restrict the operation path of the second magnetic element.

Preferably, the upper edge of an inner side of the blind hole is formed with an arc surface, wherein the center of gravity of the flame element is controlled to be disposed below the hooking portion. When the external force stops, the flame element can swing naturally on the hooking portion until the equilibrium state is recovered.

Preferably, the hooking portion comprises a connection section, which is tapered and gradually narrowed, wherein a free end of the connection section is bent upwards to form a hook for hanging the blind hole of the flame element, thereby decreasing the restriction of the swinging angle of the flame element.

Preferably, the upper base further has a limit through hole formed around the hook, wherein the flame element penetrates through the limit through hole to prevent the hooking of the blind hole of the flame element from failing.

Preferably, the flame element further has two wings extended from lateral sides of the flame element, the two wings are located at positions above and corresponding to the limit through hole, and a distance between two free ends of the two wings is greater than a width of the limit through hole.

Preferably, the upper base is connected to one end of at least one main frame, and the main frame has the other end connected to a lower base.

Preferably, a bearing seat for supporting the driving assembly may further be disposed between the upper base and the lower base.

Preferably, the bearing seat is connected to one end of a sub-frame, and the sub-frame has the other end connected to the upper base. The sub-frame may be used to properly adjust the distance between the second magnetic element and the first magnetic element, so that the repellent magnetic acting forces can achieve the optimum effect.

Preferably, the electromagnetic coil is electrically connected to a control unit, and the control unit is electrically connected to a power supply unit. The control unit controls the electromagnetic coil to generate the electromagnetic acting force to drive the second magnetic element to move in the predetermined path.

Further aspects, objects, and desirable features of the invention will be better understood from the detailed description and drawings that follow in which various embodiments of the disclosed invention are illustrated by way of examples.

DETAILED DESCRIPTION OF THE PREFERRED EMBODIMENTS

Figure 1:
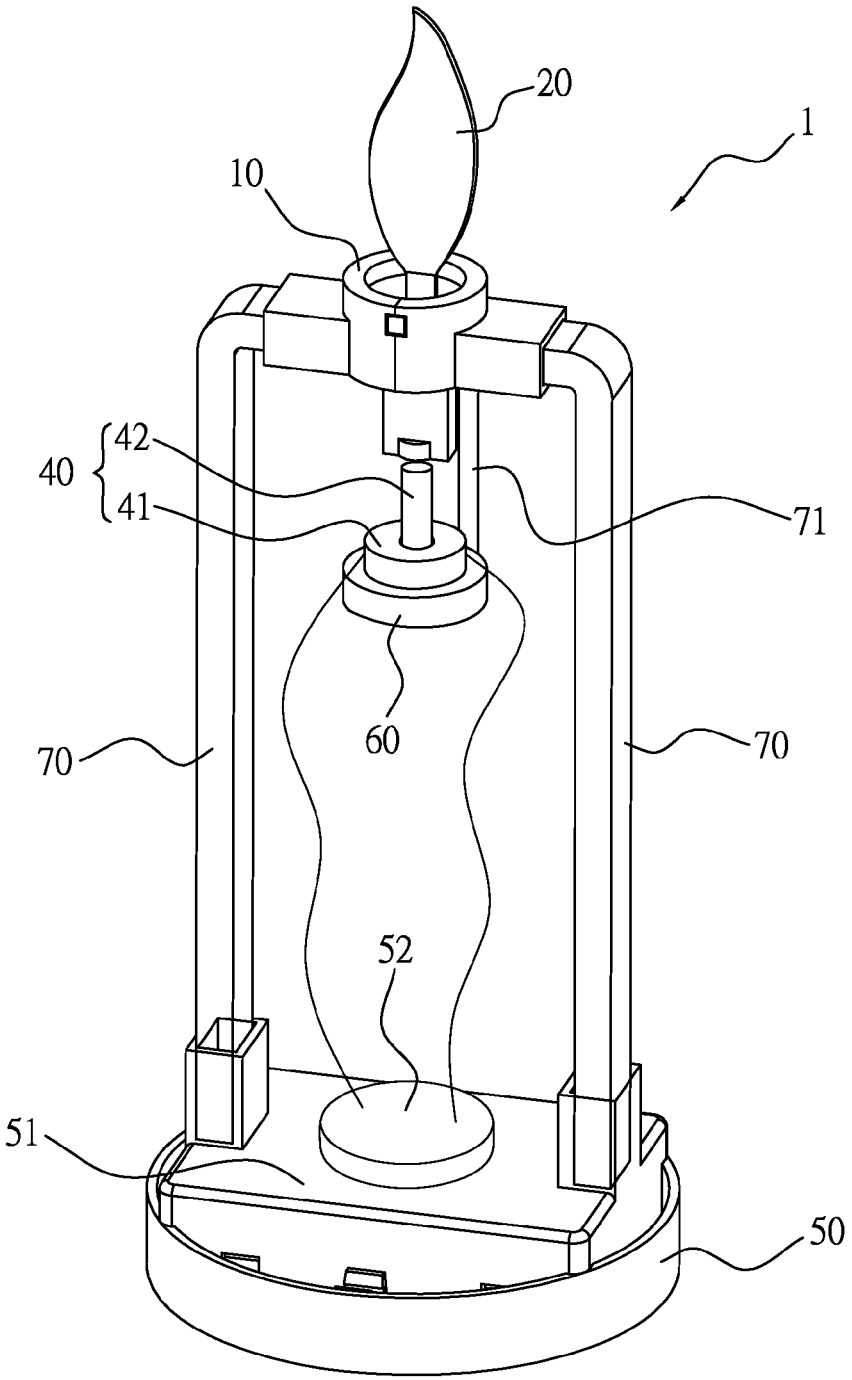
FIG. 1 is a pictorial view showing an overall structure according to an embodiment of the invention.
Figure 2:
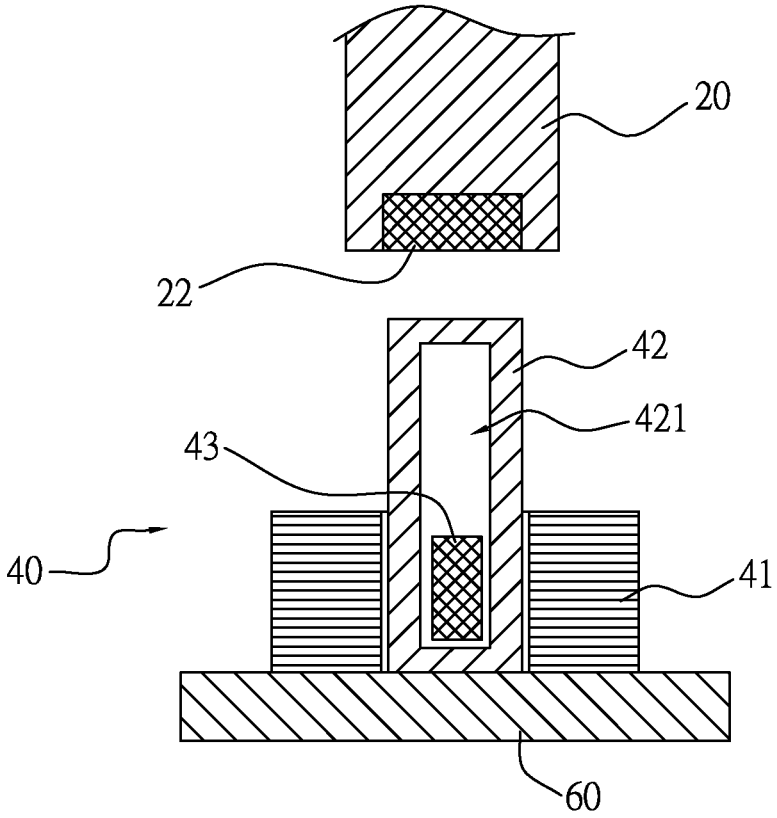
FIG. 2 is a schematically cross-sectional view showing a driving assembly according to the embodiment of the invention.
Figure 3:
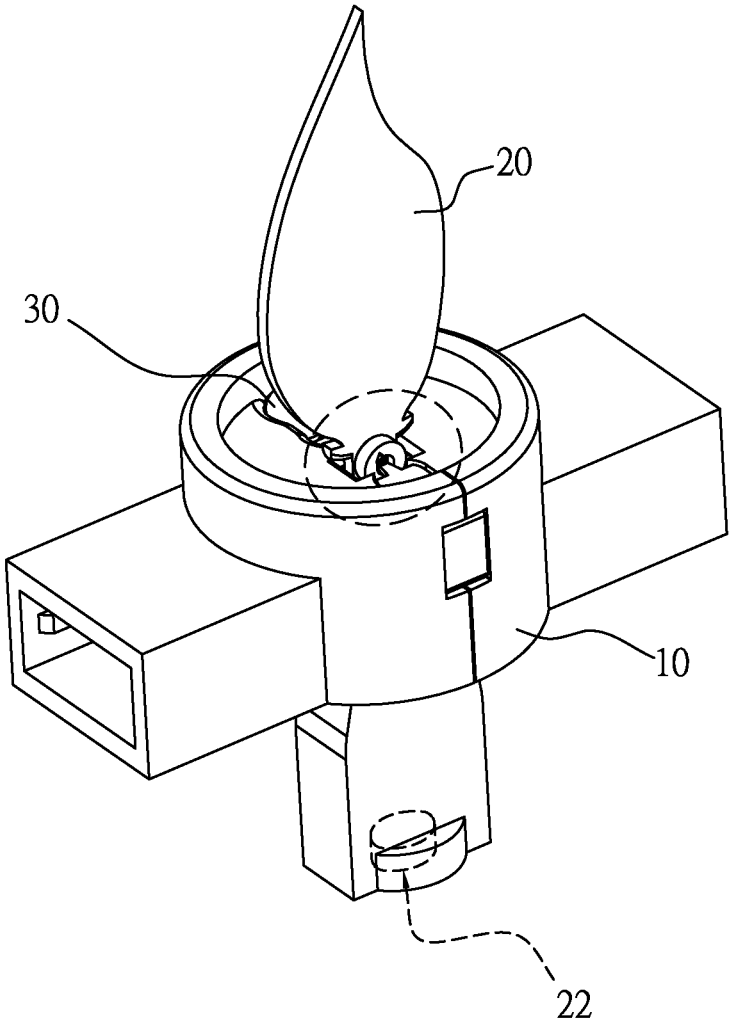
FIG. 3 is a schematic view showing structures of an upper base and a flame element according to the embodiment of the invention.

Referring to FIGS. 1 to 3, a dynamic flame simulating device 1 according to the embodiment of the invention mainly comprises an upper base 10, a flame element 20, a light source 30, a driving assembly 40, a lower base 50, a bearing seat 60, two main frames 70 and a sub-frame 71. The upper base 10 is connected to the lower base 50 through the two main frames 70, so that the upper base 10 is disposed above the lower base 50. The bearing seat 60 is connected to the upper base 10 through the sub-frame 71, and is disposed between the upper base 10 and the lower base 50. The flame element 20 and the light source 30 are disposed in the upper base 10, and the driving assembly 40 is disposed on the bearing seat 60.

Referring again to FIGS. 3 to 5, a horizontal surface of the upper base 10 is formed with a limit through hole 12, and a hooking portion 11 is disposed on one side of the limit through hole 12. The hooking portion 11 is made of a bent metal material, and has one end fixed to the upper base 10, and the other end extending horizontally toward the middle of the limit through hole 12. The portion of the hooking portion 11 extending into the limit through hole 12 comprises a connection section 111 and a hook 112. The connection section 111 is tapered and gradually narrowed, and has a free end bent upwards to form the hook 112. The hook 112 is disposed substantially at the center of the limit through hole 12.

The flame element 20 has: an upper section, which is a sheet body of the flame model; a middle section, which is narrower and penetrates through the limit through hole 12 of the upper base 10; and a lower section having a bottom portion on which a first magnetic element 22 is disposed. In this embodiment, a center of gravity of the flame element 20 approaches the position of the lower section. So, a blind hole 21 is formed inwardly at the position of the middle section and above the center of gravity of the flame element 20, wherein the inner side of the blind hole 21 is formed with an arc surface to hang from the hook 112 of the hooking portion 11. With the arrangements of the center of gravity and the arc surface, the flame element 20 can swing naturally. Furthermore, the suitable distance limitation of the limit through hole 12 can prevent the blind hole 21 from escaping from the hook 112.

The light source 30 is fixed in the upper base 10 and disposed on the other side of the flame element 20 corresponding to the hooking portion 11, and is powered on to provide light rays illuminating the upper section of the flame element 20.

As shown in FIG. 2, the driving assembly 40 is disposed on the bearing seat 60 and below the flame element 20, and comprises an electromagnetic coil 41, a limit tube body 42 and a second magnetic element 43. The electromagnetic coil 41 surrounds the limit tube body 42, and the axis of the surrounding electromagnetic coil 41 is about directly to the first magnetic element 22 on the bottom end of the flame element 20. The second magnetic element 43 is disposed in the limit tube body 42 can move in a predetermined path 421 in the limit tube body 42. The opposite facing surfaces of the second magnetic element 43 and the first magnetic element 22 are magnetic poles with the same magnetic property to generate repellent magnetic acting forces. After the electromagnetic coil 41 is powered on, the electromagnetic acting force is generated to drive the second magnetic element 43 to bounce upwards, and the repellent magnetic acting forces drive the first magnetic element 22 to make the flame element 20 swing naturally on the hook 112.

A power supply unit 51 is disposed in the lower base 50, and the user can install a battery on the bottom surface of the lower base 50 to provide the electric energy. The power supply unit 51 is electrically connected to a control unit 52 and the light source 30 on the upper base 10, and provides the required electric energy. The control unit 52 is additionally electrically connected to the electromagnetic coil 41 to properly control the electromagnetic coil 41 to generate the electromagnetic acting force with the suitable magnitude.

Figure 4:
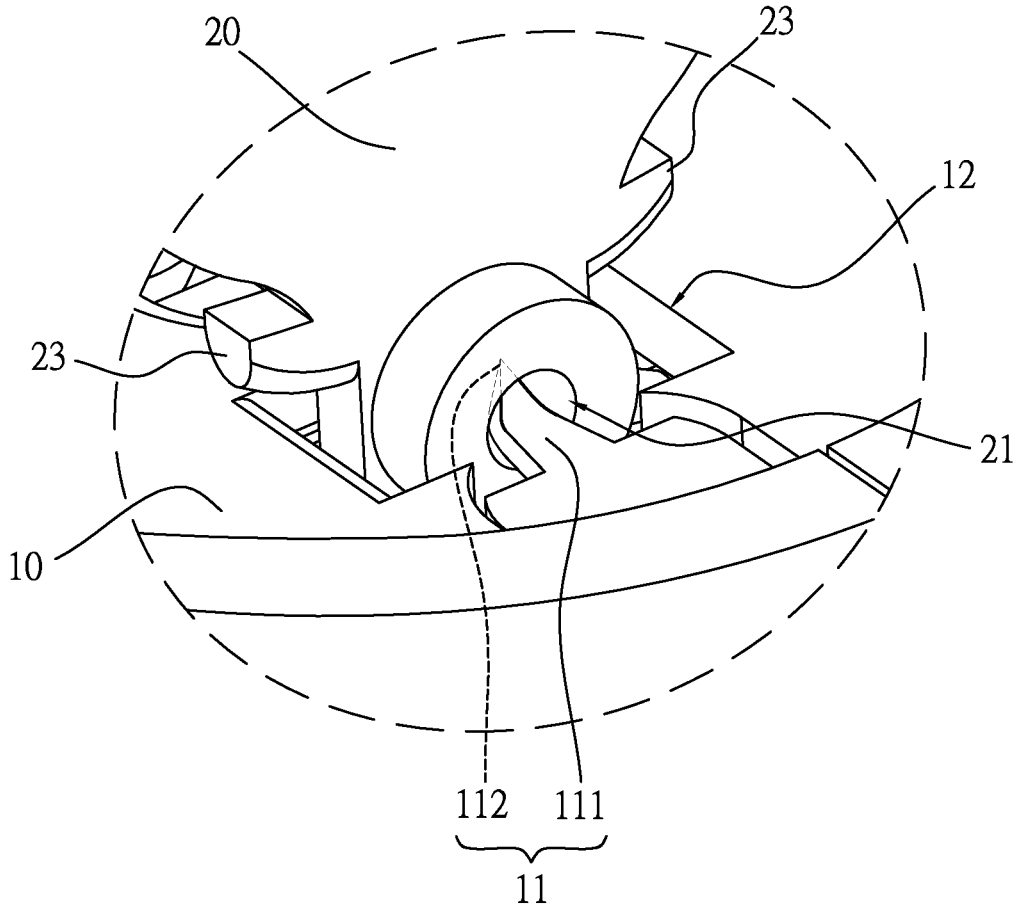
FIG. 4 is an enlarged partial view of FIG. 3.
Figure 5:
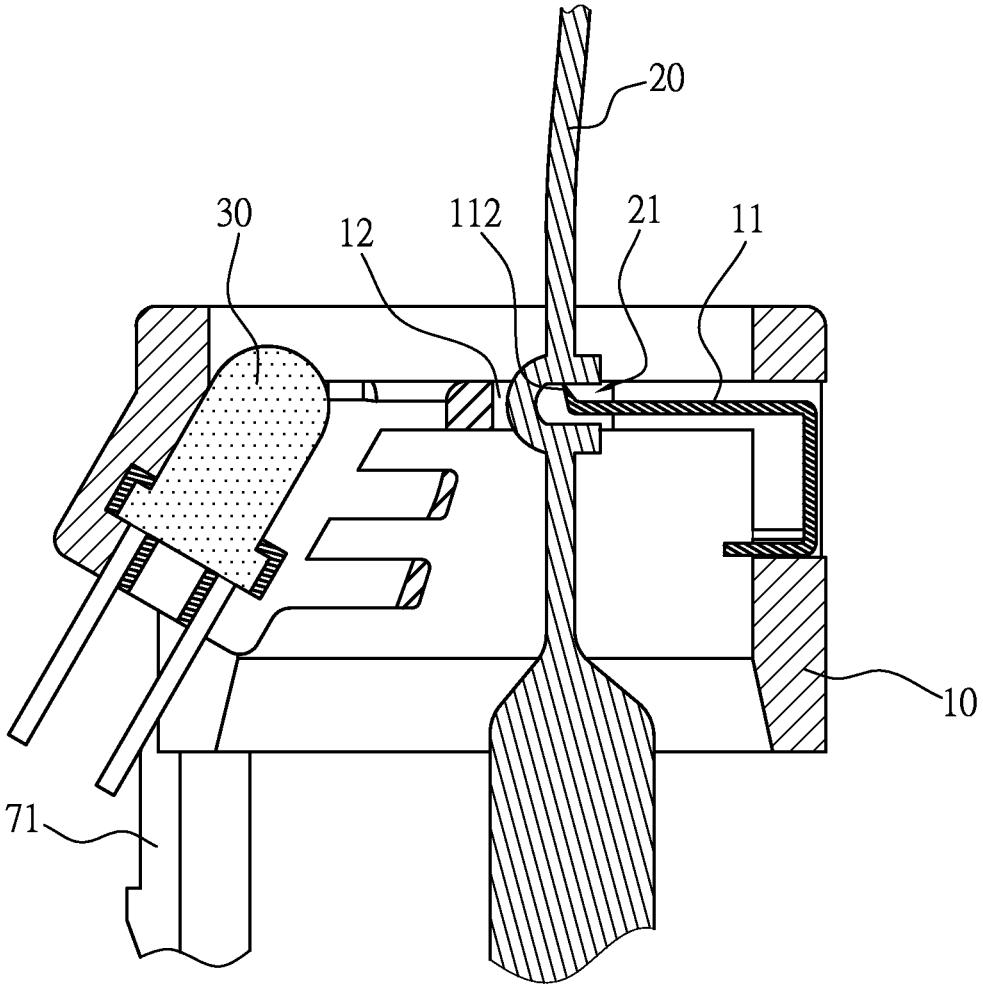
FIG. 5 is a schematically cross-sectional view showing the upper base and the flame element according to the embodiment of the invention.

In addition, as shown in FIG. 4, the lateral sides of the flame element 20 of this embodiment are further extended with two wings 23, which are disposed at positions above the limit through hole 12. The distance between two free ends of the two wings 23 is greater than the width between the width of the limit through hole 12. Thus, it is possible to further prevent the flame element 20 from escaping from the hook 112, or prevent the interference from occurring upon swinging, so that the failures can be reduced.

According to the structure of the embodiment, the user can combine a housing, having the suitable model, with the lateral sides. For example, a housing with a candle model can be combined with the lateral sides so that the flame element 20 is exposed from and above the housing to form the dynamic perception of the burning candle flame.

In summary, the structure and the effect of the invention can be used to form various lighting products. New characteristics and advantages of the invention covered by this document have been set forth in the foregoing description. It is to be expressly understood, however, that the drawings are for the purpose of illustration only and are not intended as a definition of the limits of the invention. Changes in methods, shapes, structures or devices may be made in details without exceeding the scope of the invention by those who are skilled in the art. The scope of the invention is, of course, defined in the language in which the appended claims are expressed.

What is claimed is:

1. A dynamic flame simulating device, comprising:

an upper base having a hooking portion;

a flame element having an upper section having a flame model outlook, and a lower end on which a first magnetic element is disposed, herein the flame element is formed with a blind hole in a direction of a center of gravity, wherein the blind hole is hung from the hooking portion so that the flame element may swing on the hooking portion;

a light source, which is disposed on the upper base and provides light rays on the upper section of the flame element; and a driving assembly, which is disposed below the upper base and the flame element, and comprises an electromagnetic coil, a limit tube body and a second magnetic element, wherein the electromagnetic coil surrounds the limit tube body, an axis of the electromagnetic coil is directed toward the first magnetic element on a bottom end of the flame element, and the second magnetic element is disposed in the limit tube body and is movable in a predetermined path defined in the limit tube body, wherein after the electromagnetic coil is powered on, an electromagnetic acting force is applied to the second magnetic element so that the second magnetic element reciprocates in the predetermined path toward the first magnetic element, wherein opposite facing surfaces of the second magnetic element and the first magnetic element are magnetic poles with the same magnetic property to generate repellent magnetic acting forces to drive the flame element to swing.

2. The dynamic flame simulating device according to claim 1, wherein an upper edge of an inner side of the blind hole is formed with an arc surface.

3. The dynamic flame simulating device according to claim 1, wherein the hooking portion comprises a connection section, which is tapered and gradually narrowed, and a free end of the connection section is bent upwards to form a hook for hanging the blind hole of the flame element.

4. The dynamic flame simulating device according to claim 3, wherein the upper base further comprises a limit through hole formed around the hook, wherein the flame element penetrates through the limit through hole.

5. The dynamic flame simulating device according to claim 4, wherein the flame element further has two wings extended from lateral sides, the two wings are located at positions above and corresponding to the limit through hole, and a distance between two free ends of the two wings is greater than a width of the limit through hole.

6. The dynamic flame simulating device according to claim 1, wherein the upper base is connected to one end of at least one main frame, and the main frame has the other end connected to a lower base.

7. The dynamic flame simulating device according to claim 6, further comprising a bearing seat, which is disposed between the upper base and the lower base and supports the driving assembly.

8. The dynamic flame simulating device according to claim 7, wherein the bearing seat is connected to one end of a sub-frame, and the sub-frame has the other end connected to the upper base.

9. The dynamic flame simulating device according to claim 1, wherein the electromagnetic coil is electrically connected to a control unit, and the control unit is electrically connected to a power supply unit.

10. The dynamic flame simulating device according to claim 1, wherein the second magnetic element reciprocally moves up and down in the predetermined path in the limit tube body.

* * * * *